US005884701A

United States Patent [19]

Von Plahn

[11] Patent Number: 5,884,701

[45] Date of Patent: Mar. 23, 1999

[54] DUAL DOWNHOLE INJECTION SYSTEM UTILIZING COILED TUBING

[75] Inventor: Sheldon Von Plahn, Sugar Land, Tex.

[73] Assignee: Schlumberger Technology Corpporation, Sugar Land, Tex.

[21] Appl. No.: 896,849

[22] Filed: Jul. 18, 1997

[51] Int. Cl.[6] ..... E21B 43/27

[52] U.S. Cl. ..... 166/279; 166/306; 166/247

[58] Field of Search ..... 166/250.1, 269, 166/306, 279, 66, 247

[56] References Cited

U.S. PATENT DOCUMENTS

| | | | |
|---|---|---|---|
| 4,625,803 | 12/1986 | Walhaug et al. | 166/279 X |
| 4,842,068 | 6/1989 | Vercaemer et al. | 166/269 |
| 5,042,297 | 8/1991 | Lessi | 166/250 X |
| 5,318,123 | 6/1994 | Venditto et al. | 166/250 |
| 5,361,632 | 11/1994 | Magnani | 166/250 X |
| 5,441,110 | 8/1995 | Scott, III | 166/308 |
| 5,464,059 | 11/1995 | Kristiansen | 166/269 |
| 5,507,342 | 4/1996 | Copeland et al. | 166/279 |

*Primary Examiner*—Frank Tsay
*Attorney, Agent, or Firm*—John E. Vick, Jr.; Douglas Y'Barbo

[57] ABSTRACT

A dual injection system for selectively injecting a treating fluid in a predetermined treating zone (16) of a well bore hole (10) adjacent a productive zone (14) with a marker fluid injected from the annulus (36) outside a coiled tubing string (34). The coiled tubing string (34) is inserted within the well bore hole (10) and a sensor (40) is provided on the coiled tubing string (34) with a lower end portion (42) extending below the sensor (40) for the discharge of the treating fluid from the lower end (44) of the extending end portion (42). The sensor (40) senses a detectable material, such as a radioactive material, in the marker fluid injected from the annulus (36) outside the coiled tubing string (34) and may be reciprocated within the well with the coiled tubing string (34) for determining the interface (46) between the marker fluid and the treating fluid so that the treating fluid does not enter the productive zone (18). In one embodiment (FIG. 4) the productive zone (14A) is located below the treating zone (16A) and the treating fluid contains the marker to provide the marker fluid.

16 Claims, 3 Drawing Sheets

DUAL DOWNHOLE INJECTION SYSTEM UTILIZING COILED TUBING

FIELD OF THE INVENTION

This invention relates to a dual downhole injection system for a well bore hole, and more particularly to such a system utilizing coiled tubing having a downhole sensor thereon for determining the interface between two separate fluids injected within the bore hole.

BACKGROUND OF THE INVENTION

Heretofore, it has been common to inject two separate fluids downhole in a well bore hole with one fluid having a radioactive material therein with the other fluid being non-radioactive. A gamma ray detector is lowered within the bore hole and is utilized to determine the location or level of the radioactive fluid. Different pumping rates can be provided for the separate fluids and the interface between the fluids can be determined. Such an injection method has been utilized heretofore to determine the leakage of injected water within a zone. Also, this method may be utilized for the selective injection of acid into the most beneficial zone.

For example, U.S. Pat. No. 2,870,734 dated Jan. 25, 1955 discloses a dual injection method in which two fluids are injected downhole with one of the fluids including a radioactive material. A gamma ray detector is lowered within the bore hole to monitor the interface between the two fluids which changes with different formations and pumping rates. The gamma ray detector or logging instrument is positioned on the end of a conventional electric line for monitoring or determining various characteristics of the bore hole. The logging instrument is received within a work string which receives the treating fluid for discharge from the lower end of the work string. The other fluid which is radioactive flows down the annulus between the work string and casing. In the event the well has been completed for production with a production tubing string within the casing and a packer in the annulus between the production tubing string and casing to block fluid flow, the tubing string and/or the packer must be removed before the injection of the two separate fluids downhole. Upon removal of the production tubing string and associated packers, a work string receiving a logging instrument therein may be inserted.

Other dual injection systems have utilized coiled tubing with a packer in the annulus between the coiled tubing and the casing. In such systems, the packer is positioned generally adjacent the productive zone and the pressure between the zones defined by the packer is measured to determine the injection rate of the two fluids. A sensor is not utilized in determining the interface between the two fluids. The treating pressure above and below the packer is measured for display at a surface location and fluid injection rates are adjusted so that the pressure differential between the fluids is substantially zero.

SUMMARY OF THE INVENTION

The present invention is directed to a dual injection system including the method for the injection of a well bore hole with two separate fluids, one fluid being injected down the coiled tubing string into a lower zone and the other fluid including a marker or tracer injected down the annulus outside the coiled tubing string into the upper zone and having a detectable characteristic, such as a radioactive material. A detector for the detectable characteristic, such as a gamma ray sensor, is carried by a coiled tubing string at a location above the lower end of the coiled tubing string to form a lower end portion extending downwardly from the sensor. The sensor is effective to determine the interface between the two fluids and may be reciprocated up and down by the coiled tubing for accurately locating the interface.

In one embodiment, a treatment fluid, which may comprise a gelant or acid, for example, is injected within the coiled tubing and flows down the coiled tubing string for discharge from the lower end portion below the sensor when the treatment zone is below the productive zone. The coiled tubing may be positioned within the existing production tubing, and contrary to existing techniques, there is no need to remove packers that may be positioned in the annulus between the production tubing and casing. The marker or tracer fluid flows downhole in the annulus between the production tubing string and the coiled tubing string. The marker contains a radioactive or other detectable material.

In another embodiment of the invention, the treatment zone is located above the productive zone. In this embodiment, the treating fluid is injected down the annulus between the coiled tubing string and the production tubing string with the marker fluid contained in the treating fluid.

A further embodiment of the invention has a pair of spaced sensors on the coiled tubing for detecting the interface between the sensors with minimal reciprocation of the sensors and coiled tubing string.

It is an object of this invention to provide a dual injection system for injecting a marker fluid down the annulus outside the coiled tubing string and a second fluid down the coiled tubing string with a sensor on the coiled tubing string detecting the marker fluid to locate the interface between the two fluids.

An additional object of this invention is to provide such a dual injection system including a coiled tubing string having a lower end portion extending beyond the sensor a distance sufficient to maintain the lower end portion below the intended interface position during limited reciprocation of the sensor and coiled tubing string.

Other objects, features, and advantages of the invention will be apparent from the following specification and drawings.

DESCRIPTION OF THE INVENTION

Figure 2:
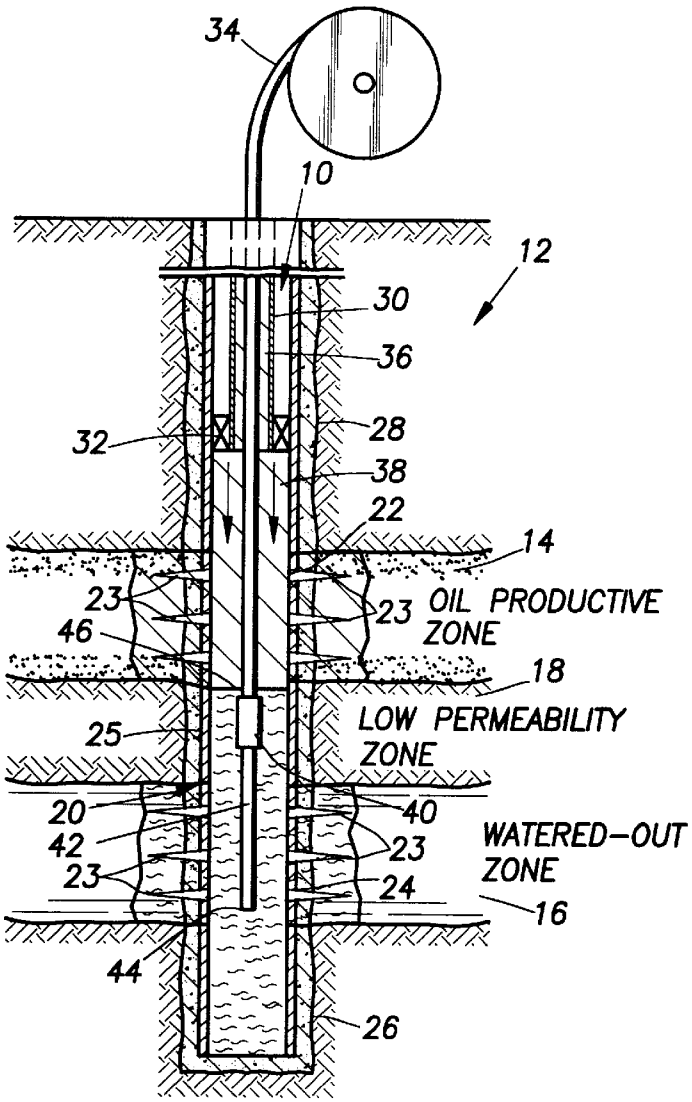
FIG. 2 is a sectional view, partially schematic, showing the dual injection system of the present invention utilized with the well bore hole of FIG. 1 and showing a coiled tubing string with a sensor thereon extending within the bore hole to the lower treating zone.

Referring to the drawings for a better understanding of this invention, a well bore hole is shown generally at 10 extending vertically within a formation 12 and having a plurality of subsurface strata defining a productive zone shown at 14 and a lower watered-out zone shown at 16. An intermediate permeable zone 18 is shown between productive zone 14 and watered-out zone 16 so that water from zone 16 flows to productive zone 14. Productive zone 14 remains productive and it is desired to eliminate or prevent the flow of water from zone 16 into productive zone 14. While a separate permeable intermediate zone 18 is shown in the drawings between zones 14 and 16, it is to be understood that in some instances a separate intermediate zone would not be present between zones 14 and 16. However, in any event, a flow path is provided between zones 14 and 16 and the flow path, for example, may comprise the bore hole or poor cement outside the casing. In some instances, a casing may not be extended to the zones.

Figure 1:
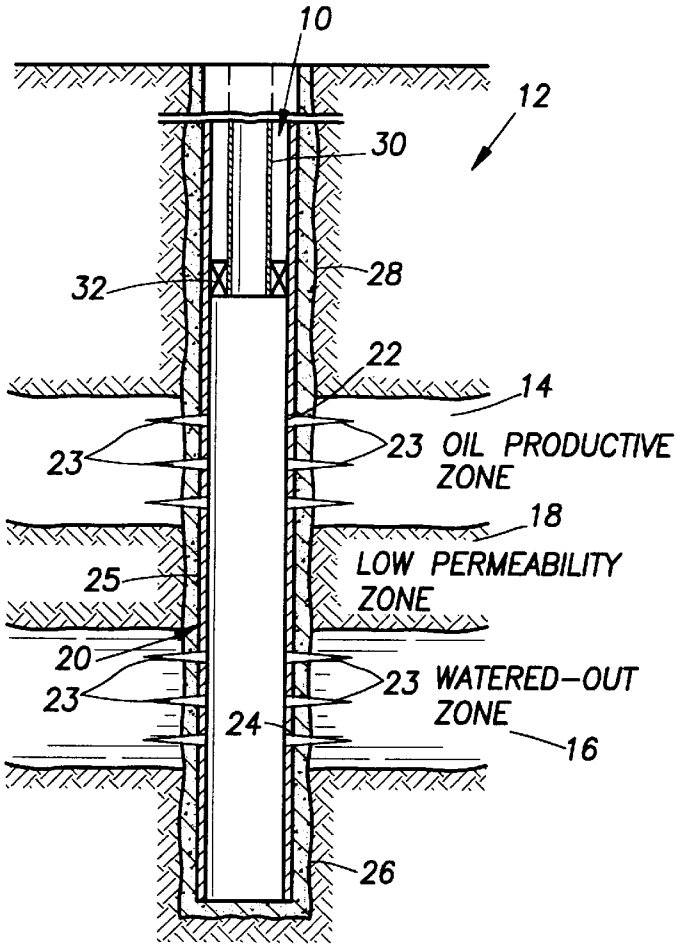
FIG. 1 is a sectional view of a well bore hole including a productive zone and a watered-out zone, and having a perforated casing therein with production tubing mounted within the casing over the productive zone.

A casing shown generally at 20 extending within bore hole 10 has a perforated section 22 adjacent productive zone 14 and a perforated section 24 adjacent watered-out zone 16. Imperforate section 25 extends between perforated sections 22 and 24. Perforations 23 extend through the casing and the adjacent cement at perforated sections 22 and 24. Casing 20 is cemented at its lower end at 26 and is cemented at 28 adjacent productive zone 14. Production tubing 30 extends downwardly within casing 20 and a packer 32 is provided at the lower end of production tubing 30 in the annulus between the production tubing 30 and casing 20. The present invention is particularly adapted for use with a well such as shown in FIG. 1 to prevent the flow of water from zone 16 into productive zone 14. While a cement liner is shown in the drawings as positioned about casing 20 between the perforated sections 22 and 24, poor quality cement in this area causes poor zone isolation between oil productive zone 14 and watered-out zone 16 and permits fluid flow outside of the casing so that water may enter productive zone 14.

The well as shown in FIG. 1 is particularly adapted for utilization by the system comprising the present invention. Referring to FIG. 2, the well bore hole 10 as shown in FIG. 1 has a coiled tubing string generally indicated at 34 inserted within bore hole 10 from a surface location. A suitable coiled tubing injector forces the coiled tubing downward within the well as shown in FIG. 2. Coiled tubing string 34 forms an annulus 36 between coiled tubing string 34 and production tubing 30. An annulus 38 is formed below production tubing 30 between coiled tubing string 34 and outer casing 20. Coiled tubing string 34 includes a gamma ray sensor 40 and a lower end portion 42 of coiled tubing string 34 extends downward from sensor 40 and has a fluid discharge outlet 44 at its lower end. Since a poor cement bond exists about casing 20 between zones 14 and 16, water may enter zone 14 from zone 16 and it is desirable to plug or stop the flow of water into zone 14. Thus, it is desired to inject a plugging fluid, such as a polymer gelant, into zone 16 to prevent the flow of water into productive zone 14. When the plugging fluid is injected in zone 16, it is necessary to determine the level of the plugging fluid so that the plugging fluid does not enter the productive zone 14. For this purpose, it is desirable to inject a second marker or tracer fluid in the productive zone 14 so that an interface 46 between the treating fluid and the marker fluid can be determined which indicates the level of the plugging fluid. The marker fluid includes a detectable characteristic that may be detected by sensor 40 thereby to locate the position of the marker fluid. The lowest position of the marker fluid would indicate the interface between the marker fluid and the plugging fluid. A detectable characteristic, such as a radioactive material, has been utilized heretofore and gamma ray sensor 40 easily detects the radioactive material. The radioactive material may be provided in a benign protective fluid, such as water, with the radioactive material or radioactive isotope being continuously added to the marker fluid injected in bore hole or well 10.

Figure 3:
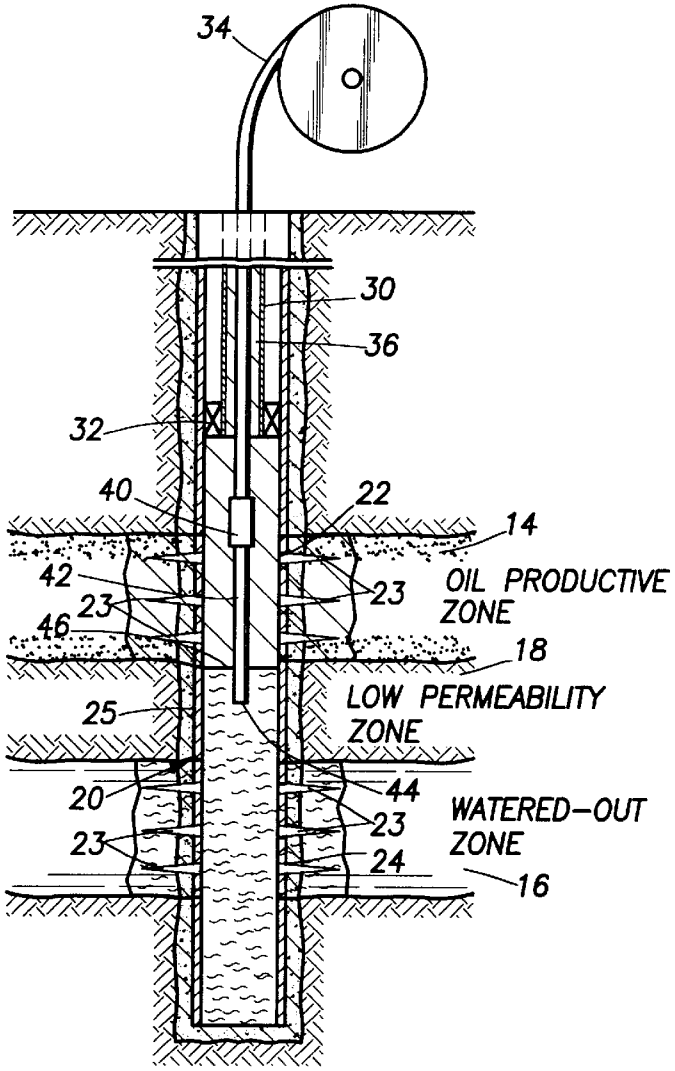
FIG. 3 is a sectional view generally similar to FIG. 2 but showing the coiled tubing string reciprocated to its uppermost position for locating the fluid interface between the treating fluid and the marker fluid. The lower end portion of the coiled tubing string remains below the interface.

In operation, coiled tubing string 34 is inserted within well bore hole 10 by a suitable coiled tubing injector apparatus at a surface location, as well known, to a predetermined depth in well 10 so that sensor 40 is positioned in well casing 20 at a location generally between the perforated sections 22 and 24. In this location, the dual injection operation is commenced with a plugging fluid, such as a polymer gelant, injected down the coiled tubing string 34 for discharge from outlet end 44 of lower end portion 42 below sensor 40. The plugging material flows outward from the perforated section 24 into the watered-out zone 16. Simultaneously, the marker fluid containing a radioactive material is injected down annulus 36 between coiled tubing string 34 and production tubing 30 for flow into productive zone 14. Various pumping rates may be utilized depending on the areas to be injected. To determine the interface between the marker fluid and the treating fluid as shown by interface 46 in FIG. 2, coiled tubing 34 including sensor 40 may be reciprocated as illustrated in FIG. 3. Sensor 40 is raised to its uppermost position as shown in FIG. 3 in which lower outlet 44 remains below the interface 46. The reciprocation of sensor 40 locates the position of interface 46 and the injection rate of the treating fluid from coiled tubing 34 is decreased or stopped before interface 46 reaches productive zone 14, or is slightly within productive zone 14. The plugging fluid is pumped down coiled tubing string 34 until the desired interface at 46 is reached. Sensor 40 which is reciprocated continuously senses the level of the marker fluid discharged through annulus 36 thereby to accurately locate interface 46. The entire dual injection system is applied while production tubing 30 and packer 32 remain installed within casing 20. The location of lower end portion 42 of coiled tubing string 34 below sensor 40 permits sensor 40 to be reciprocated a substantial distance without the discharge of plugging fluid within productive zone 14 even though sensor 40 is positioned a substantial distance above the lower surface of the productive zone 14.

While the treating fluid has been illustrated as a plugging fluid, it is apparent that other types of treating fluids could be utilized by the present dual injection system, such as injecting acid within the zone adjacent a productive zone. Further, while the detectable characteristic of the tracer fluid is illustrated as a radioactive material, it is apparent that other types of detectable characteristics could be utilized, such as resistivity, pH, or viscosity, for example.

Figure 4:
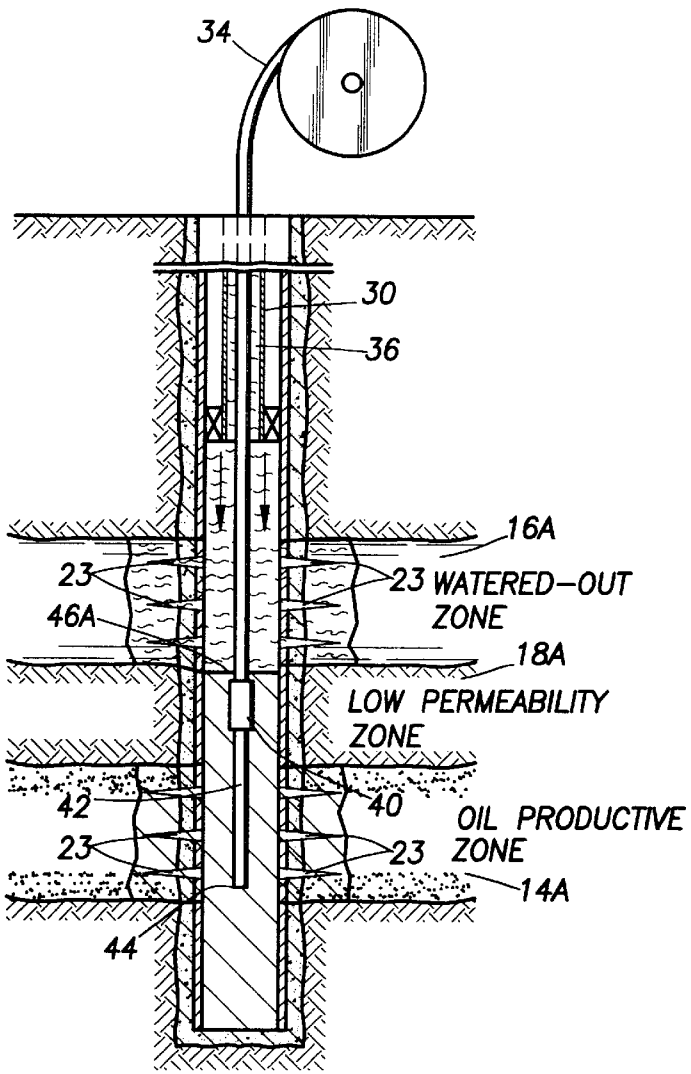
FIG. 4 is a sectional view of another embodiment of the dual injection system of this invention in which an upper watered-out zone is positioned above the lower productive zone with the treatment fluid being discharged from the annulus outside the coiled tubing string into the upper watered-out zone.

The embodiment shown particularly in FIGS. 2 and 3 utilizes a dual injection system of the present invention for a well in which the productive zone 14 is positioned above the treating zone 16. In some instances, the productive zone may be below the treating zone as shown in the embodiment of FIG. 4. Treating zone 16A is positioned above the productive zone 14A with a low permeability zone 18A shown therebetween. In this application, the treating fluid containing the marker, such as radioactive isotopes, is discharged through annulus 36 between coiled tubing string 34 and production tubing 30 for flow into treating zone 16A.

The benign protective fluid, such as water, without the marker therein is injected down coiled tubing string 34. Sensor 40 is reciprocated to locate interface 46A between the lower surface of the treating fluid containing the marker and the upper surface of the protective fluid. During the reciprocation, lower outlet portion 44 of the coiled tubing string 34 remains below the interface 46A.

Figure 5:
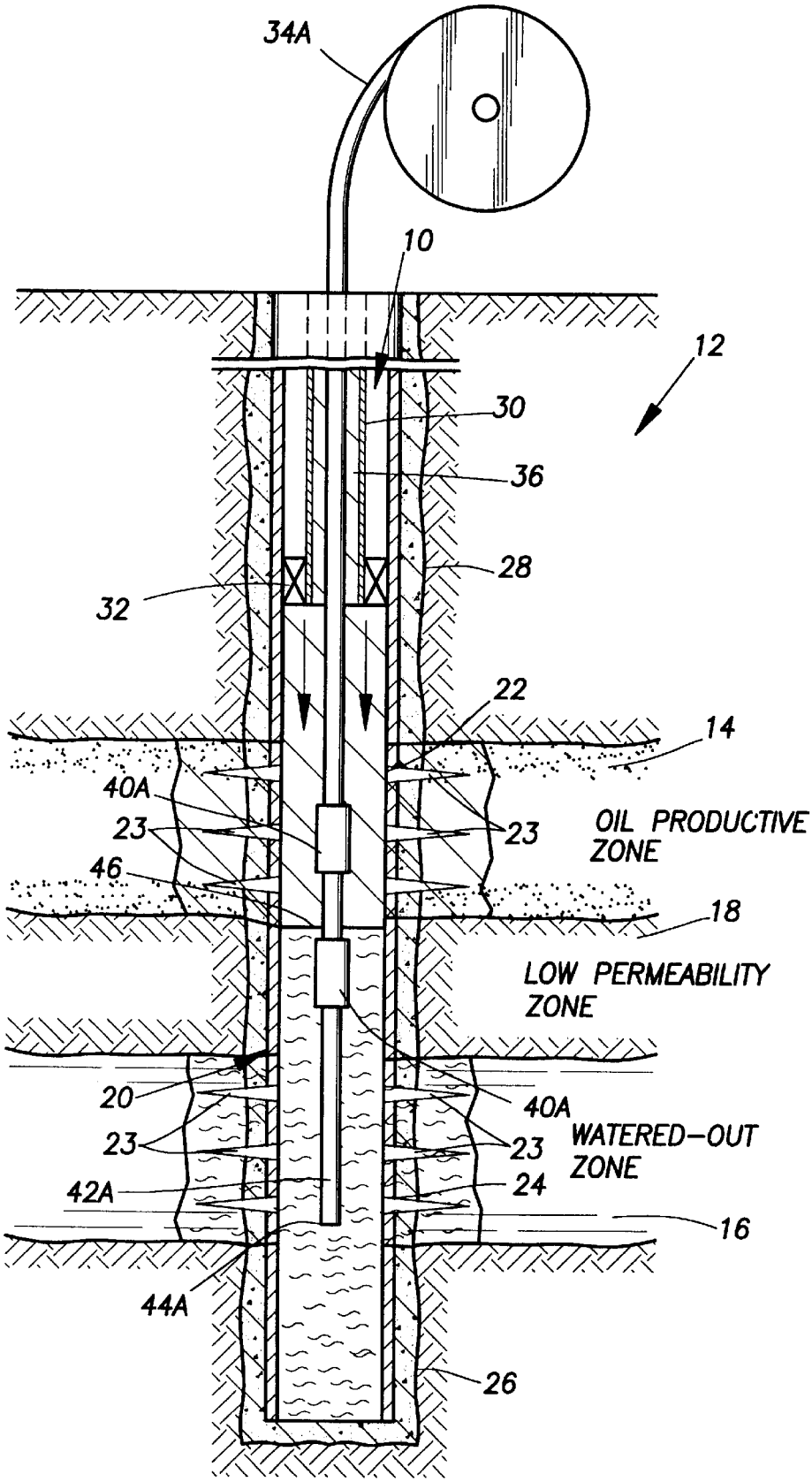
FIG. 5 is a sectional view of a further embodiment of this invention in which a pair of sensors are positioned on the coiled tubing string in a spaced relation for determining the interface between the two injected fluids.

Referring to FIG. 5, another embodiment is shown in which coiled tubing string 34A has a pair of sensors 40A positioned thereon with a lower end portion 42A extending downwardly from the lowermost sensor 40A. Sensors 40A may be spaced, for example, a distance of about six to eight feet from each other. The plugging fluid is discharged from the lower end 44A of extending end portion 42A and the treating fluid is discharged from annulus 36 between coiled tubing string 34A and production tubing string 30. By having a pair of sensors 40A for detecting the radioactive marker fluid, interface 46 may be located with a minimum of reciprocation of coiled tubing 34A. The embodiment of FIG. 5 may also be utilized with the embodiment shown in FIG. 4.

While preferred embodiments of the present invention have been illustrated in detail, it is apparent that modifications and adaptations of the preferred embodiments will occur to those skilled in the art. However, it is to be expressly understood that such modifications and adaptations of the preferred embodiments as occur to those skilled in the art are within the spirit and scope of the present invention as set forth in the following claims.

What is claimed is:

1. A dual injection system for a well in a well formation having a productive zone and an adjacent treating zone traversed by a bore hole in the well formation; said system comprising:

a coiled tubing string positioned within said bore hole and extending to said zones to define an annulus in the bore hole between the coiled tubing and the periphery of the bore hole;

a sensor carried by said coiled tubing string for positioning in the bore hole at a location generally between the productive zone and the treating zone, one of the zones being a far zone from the surface and the other zone being a near zone to the surface;

a first fluid injected down said coiled tubing for discharge from said lower end portion into said far zone;

a second marker fluid injected down said annulus for injection within said near zone; said second fluid having a marker therein comprising a characteristic detectable by said sensor; and said sensor effective to detect the location of the marker fluid to determine the interface between said fluids.

2. The dual injection system as set forth in claim 1 wherein said productive zone is said near zone and said treating zone is said far zone, said first fluid being a treating fluid injected into said treating zone and said second fluid including a marker injected into said productive zone.

3. The dual injection system as set forth in claim 1 wherein said productive zone is said far zone and said treating zone is said near zone, said first fluid being a protective fluid injected into said productive zone and said second fluid being a treating fluid containing said marker and injected into said treating zone.

4. The dual injection system as set forth in claim 2 wherein said first fluid is a plugging fluid to prevent fluid flow through said treating zone, and said second fluid is water containing radioactive material;

said sensor being a gamma ray detector for detecting the location of said second fluid to determine the interface between said first and second fluids.

5. The dual injection system as set forth in claim 3 wherein said first fluid is water and said second fluid is a plugging fluid containing a radioactive material;

said sensor being a gamma ray detector for detecting the location of said second fluid to determine the interface between said first and second fluids.

6. The dual injection system as set forth in claim 1 wherein said coiled tubing string has a lower end portion extending from said sensor for positioning in said far zone from the surface, said lower end portion being a sufficient length to remain below the interface upon reciprocation of said coiled tubing string for detecting said interface.

7. The dual injection system as set forth in claim 1 wherein a pair of sensors are carried by said coiled tubing string and spaced longitudinally from each other to define near and far sensors from the surface, said coiled tubing string having a lower end portion extending from said far sensor.

8. The dual injection system as set forth in claim 1 wherein:

a casing is mounted within said bore hole and extends through said zones, said casing being perforated at said zones to permit the flow of fluid into said zones.

9. The dual injection system as set forth in claim 8 wherein:

a production tubing string is received within said casing above said zones and defines an annulus between said tubing string and said casing, and a packer is positioned in said annulus to block fluid flow from said casing and up said annulus.

10. A dual injection well treating method for a well having a productive zone and a treating zone traversed by a bore hole in the well formation forming the zones, one of said zones being a far zone from the surface and the other zone being a near zone from the surface; said method comprising the following steps:

providing a coiled tubing string having a sensor thereon and a lower end portion extending from said sensor, said lower end portion of said coiled tubing string having a fluid discharge opening at its end;

inserting the coiled tubing string down said bore hole to said zones with said sensor positioned generally in an area between said zones with said lower end portion extending into the far zone from the surface, the coiled tubing string forming an annulus with the periphery of the bore hole;

injecting a first fluid down said coiled tubing string for discharge from said lower end of said lower end portion into said far zone; and injecting a second marker fluid down said annulus for injection within said near zone from the surface; said marker fluid including a characteristic detectable by said sensor, said sensor effective to detect the location of the marker fluid to determine the interface between said fluids.

11. The dual injection well treating method as set forth in claim 10 wherein said productive zone is said near zone and said treating zone is said far zone;

injecting said marker fluid down said annulus for injection within said productive zone; and injecting said first fluid comprising a treating fluid down said coiled tubing string for injection within said treating zone.

12. The dual injection well treating method as set forth in claim 10 wherein said productive zone is said far zone and said treating zone is said near zone;

injecting said first fluid down said coiled tubing string for injection within said productive zone; and injecting said second marker fluid comprising a treating fluid having a marker therein down said annulus for injection within said treating zone.

13. The dual injection well treating method as set forth in claim 10 including the steps of:

providing a casing within said bore hole;

providing production tubing within said casing to define a second annulus between said production tubing and said casing;

providing a packer in the second annulus between said tubing and said casing at a position above said productive zone;

inserting said coiled tubing within said production tubing to define a third annulus between said coiled tubing and said production tubing; and injecting said second marker fluid down said third annulus between said production tubing and said coiled tubing.

14. The dual injection well treating method as set forth in claim 13 including the step of:

perforating said casing at said productive zone and at said treating zone.

15. The dual injection well treating method as set forth in claim 10 including the step of:

injecting a plugging material as said first fluid.

16. The dual injection well treating method as set forth in claim 15 including the step of injecting water having a detectable material therein as said second marker fluid.

* * * * *